US010359254B1

(12) United States Patent
Kempf et al.

(10) Patent No.: US 10,359,254 B1
(45) Date of Patent: Jul. 23, 2019

(54) CROSSBOW WITH BUILT IN ELECTRIC COCKING

(71) Applicants: James J. Kempf, Coralville, IA (US); Rex E. Isenhower, Stanwood, IA (US); Dorge O. Huang, Henry, IL (US)

(72) Inventors: James J. Kempf, Coralville, IA (US); Rex E. Isenhower, Stanwood, IA (US); Dorge O. Huang, Henry, IL (US)

(73) Assignee: ARCHERY INNOVATORS, Tiffin, IA (US)

( * ) Notice: Subject to any disclaimer, the term of this patent is extended or adjusted under 35 U.S.C. 154(b) by 0 days.

(21) Appl. No.: 16/120,565

(22) Filed: Sep. 4, 2018

Related U.S. Application Data

(60) Provisional application No. 62/554,205, filed on Sep. 5, 2017.

(51) Int. Cl.
*F41B 5/18* (2006.01)
*F41B 5/14* (2006.01)
*F41B 5/12* (2006.01)

(52) U.S. Cl.
CPC ..... *F41B 5/1469* (2013.01); *F41B 5/12* (2013.01)

(58) Field of Classification Search
CPC ..... F41B 5/12; F41B 5/123; F41B 5/1469
USPC ..... 124/25
See application file for complete search history.

(56) References Cited

U.S. PATENT DOCUMENTS 5,220,906 A * 6/1993 Choma ..... F41B 5/12 124/25
6,799,566 B1 * 10/2004 Malucelli ..... F41B 5/12 124/25
6,913,007 B2 * 7/2005 Bednar ..... F41B 5/123 124/25
7,017,568 B1 * 3/2006 Smith ..... F41B 5/12 124/25
7,174,884 B2 * 2/2007 Kempf ..... F41B 5/105 124/25
7,784,453 B1 * 8/2010 Yehle ..... F41B 5/12 124/25
7,814,984 B1 10/2010 Giroux
8,104,461 B2 * 1/2012 Kempf ..... F41B 5/12 124/25
8,240,299 B2 * 8/2012 Kronengold ..... F41A 11/02 124/25
8,375,928 B1 * 2/2013 Bednar ..... F41B 5/1469 124/25
8,443,790 B2 * 5/2013 Pestrue ..... F41B 5/1469 124/25
8,452,631 B2 5/2013 Doss et al.
(Continued)

*Primary Examiner* — Alexander R Niconovich
(74) *Attorney, Agent, or Firm* — Donald J. Ersler

(57) ABSTRACT

A crossbow with built in electric cocking preferably includes a motor, a drive device, a pair of carriage drive shafts and a pair of string carriages. The motor preferably includes a gearbox with an output shaft. The drive device includes a support frame and a drive shaft rotatably retained in the support frame. A drive gear is retained on one end of the drive shaft. An opposing end of the drive shaft is connected the output shaft. First and second carriage drive shafts each include a threaded drive shaft and a carriage drive gear retained on one end of the threaded drive shaft. The drive gear drives the carriage drive gear. First and second string carriages each include a string catch and a threaded tap. The threaded tap is sized to threadably receive the threaded drive shaft.

14 Claims, 14 Drawing Sheets

(56) References Cited

U.S. PATENT DOCUMENTS

| | | | | |
|---|---|---|---|---|
| 8,499,753 | B2 * | 8/2013 | Bednar | F41B 5/123<br>124/25 |
| 9,341,432 | B1 * | 5/2016 | Wohleb | F16H 25/20 |
| 9,341,434 | B2 * | 5/2016 | McPherson | F41B 5/123 |
| 9,958,232 | B1 * | 5/2018 | Egerdee | F41B 5/1403 |
| 2014/0261360 | A1 * | 9/2014 | Pulkrabek | F41B 5/1469<br>124/35.2 |

* cited by examiner

CROSSBOW WITH BUILT IN ELECTRIC COCKING

CROSS-REFERENCES TO RELATED APPLICATIONS

This is a utility patent application, which claims the benefit of provisional application No. 62/554,205 filed on Sep. 5, 2017.

BACKGROUND OF THE INVENTION

Field of the Invention

The present invention relates generally to archery, and more specifically to an electric built-in cocking device for a crossbow, which allows an archer to more easily cock a crossbow, and de-cock a crossbow.

Discussion of the Prior Art

U.S. Pat. No. 7,174,884 to Kempf et al. discloses a crossbow with built-in cocking mechanism, having a string retainer coupled to a flexible member and spool. U.S. Pat. No. 8,140,461 discloses a crossbow with built-in cocking mechanism, having a means for engaging a string coupled to a flexible member and spool. U.S. Pat. Nos. 8,240,299 and 8,452,631 to Kronengold et al. discloses a crossbow with built-in cocking device having a movable string release. U.S. Pat. No. 7,814,984 to Giroux discloses a anti dry-fire device for crossbows. U.S. Pat. No. 7,784,453 to Yehle discloses a crossbow with built-in cocking mechanism for a crossbow, having a string release coupled to a chain. Though all of these methods of cocking a crossbow are functional, they require the use of flexible chords or chains that may stretch or break, causing damage to the crossbow, or injury to the user. Therefore, the manner by which they operate is not acceptable for smooth operation, function, and longevity.

Accordingly, there is a need in the art for a crossbow with built-in electric cocking, which has no flexible chords or chains; may be manually or electrically operated; and uses a proven linear motion type mechanism to cock and de-cock a crossbow.

SUMMARY OF INVENTION

The enclosed invention discloses a crossbow, and more specifically a built in electric cocking mechanism for a crossbow that may also be utilized with an optional built in, battery assembly and power source, or power coming from an external source connected by a USB port or similar connection. The motor gearbox assembly may or may not have a clutch assembly, whereby the rotational force applied by the said motor gearbox assembly reaches a predetermined amount of force, the rotation of the main drive shaft ceases. The motor gearbox assembly may be one of a planetary gear set, a spur gear set, and a direct drive gear. Further, a drive shaft coupling spring may be utilized as a connector between the output shaft of the motor gear assembly and the drive shaft of the drive gear, providing for shock resistance to prevent damage to the motor and gears. A switch may be provided as to start, stop, and reverse the direction of rotation of the motor gearbox assembly, as well as switches and or circuits that may control operation of the motor gear set. Power is preferably provided through an external power source and built-in crossbow USB capabilities. The crossbow may also have a controller with electronics built into a monitor, which includes such things as the number of times the crossbow has been cocked; de-cocked; fired; time between cocking cycles; and how long the crossbow has been in the cocked position without being fired. The controller may also be bluetooth capable with programming to disallow a non approved user to operate the crossbow.

In use, a clutch pack in the motor gear assembly would prevent the carriage from travel past a predetermined forward or rearward position of the carriage during the cocking and unlocking procedure. In an alternative embodiment, there would be no clutch pack in the motor assembly, wherein the force of the gear drive at the end of the cocking procedure would cause the motor to simply stop. A microswitch or electronic eye, or other type of controller known in the art may also be used to control the operation of the motor gearbox assembly.

Unique to the disclosed invention is the use of an integrated motor gear assembly with internal or external power source. The output shaft of the motor gear assembly is one of connected to a main drive shaft drive gear and direct connection to a drive gear. The main drive shaft drive gear is coupled to the carriage shaft drive gears. As the drive shaft drive gear rotates, it causes rotation of the carriage drive shafts. At least one internally threaded carriage is journaled on the carriage drive shaft assemblies. The assembly acts as a worm drive or acme thread conveyor. As the carriage shafts rotate, the carriage moves forward or backwards, depending on the direction of rotation of the shafts.

The carriages are set at the front end of the bow when at rest, or when the bow is cocked and ready to shoot. Prior to use, the user connects the USB or similar power source to the power input port of the motor assembly, and when in use, a switch is moved to a first position, and the drive gear is rotated in a first direction, causing the carriages to engage the string, and move the string towards the string catch. Once the string catch is latched to the string, a switch is moved to a second (neutral) position, and then a third position causing the drive gear to rotate in a second direction until the carriage is in the at-rest position.

Another unique feature of the disclosed invention is the optional built-in, removable battery assembly that may take the place of external power source, without removal of the crank assembly.

Another unique feature of the disclosed invention is the use of a USB capable power and communication system.

DETAILED DESCRIPTION OF THE PREFERRED EMBODIMENTS

Figure 1:
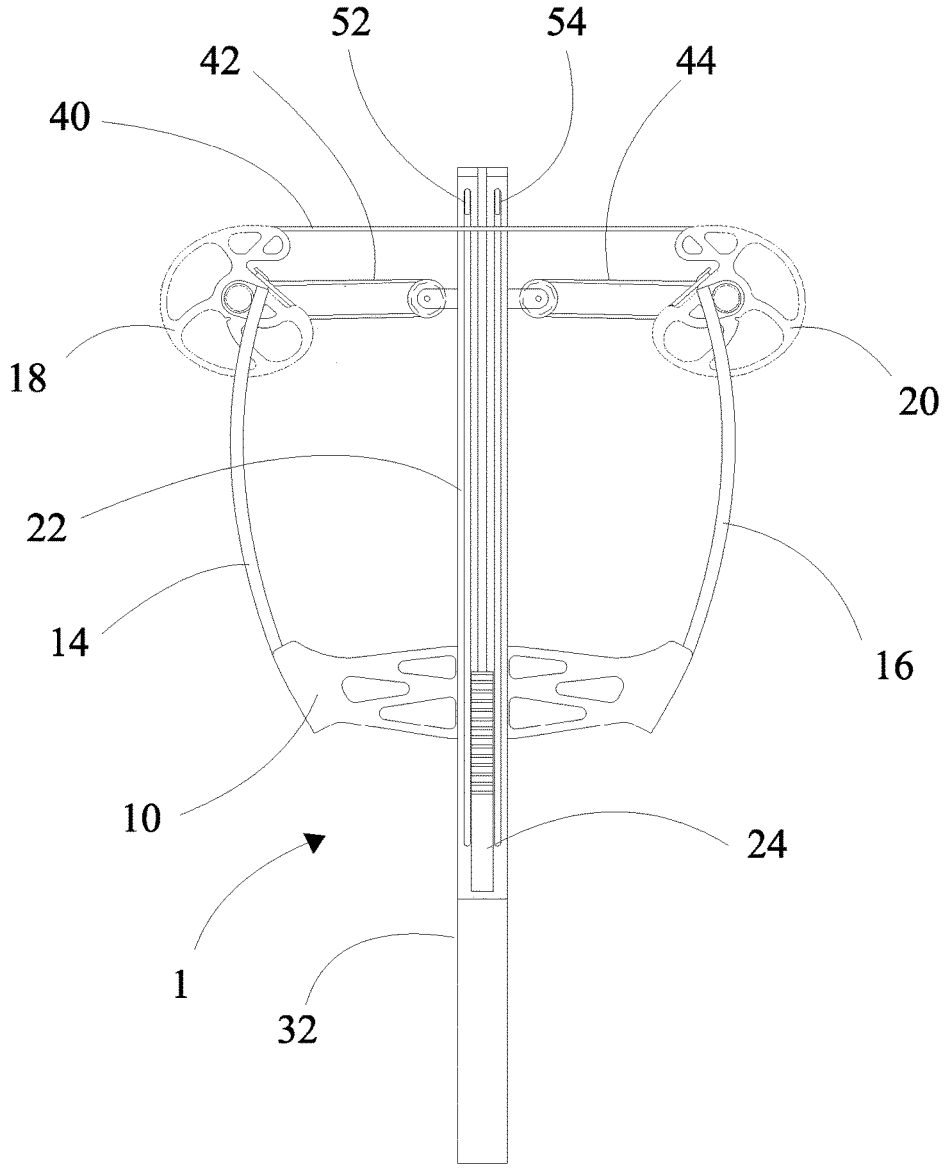
FIG. 1 is a top view of a crossbow with built in electric cocking in an at rest position of the present invention.
Figure 1A:
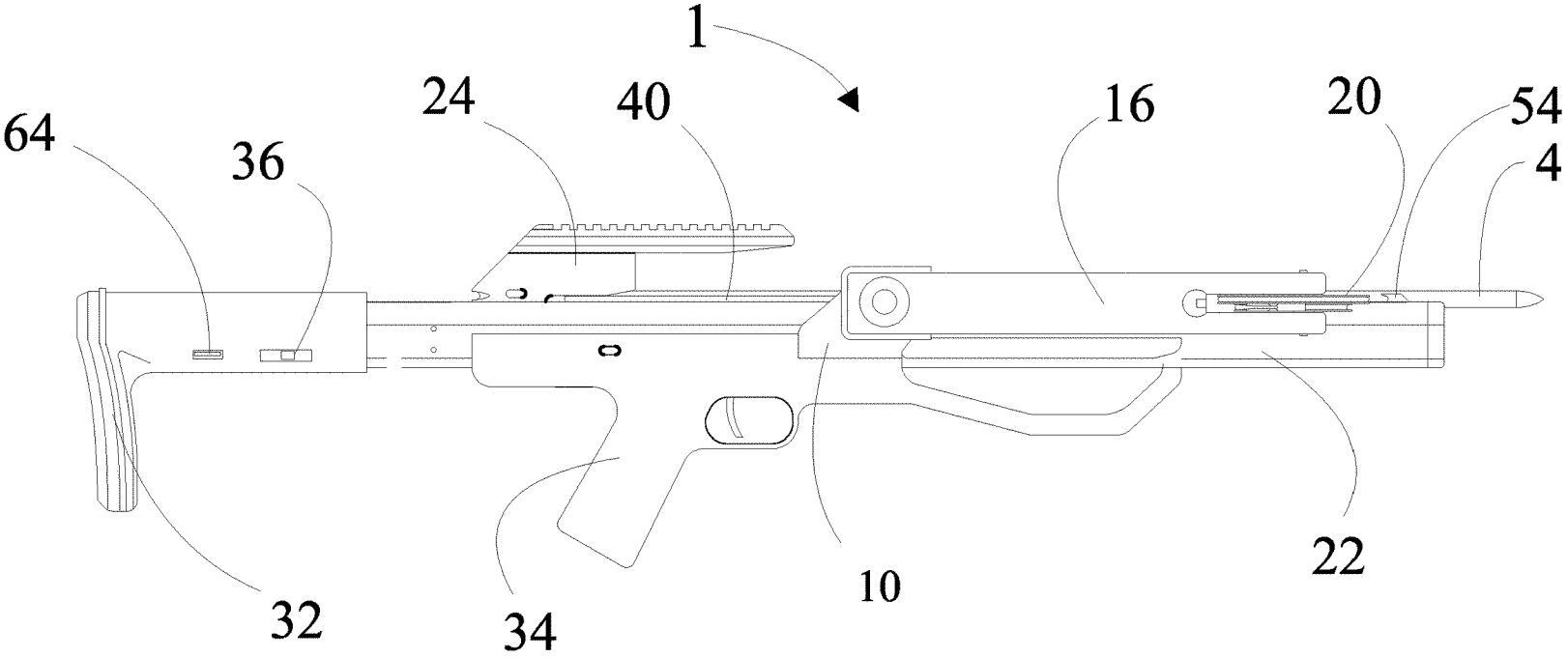
FIG. 1A is a side view of a crossbow with built in electric cocking in an at rest position of the present invention.
Figure 1B:
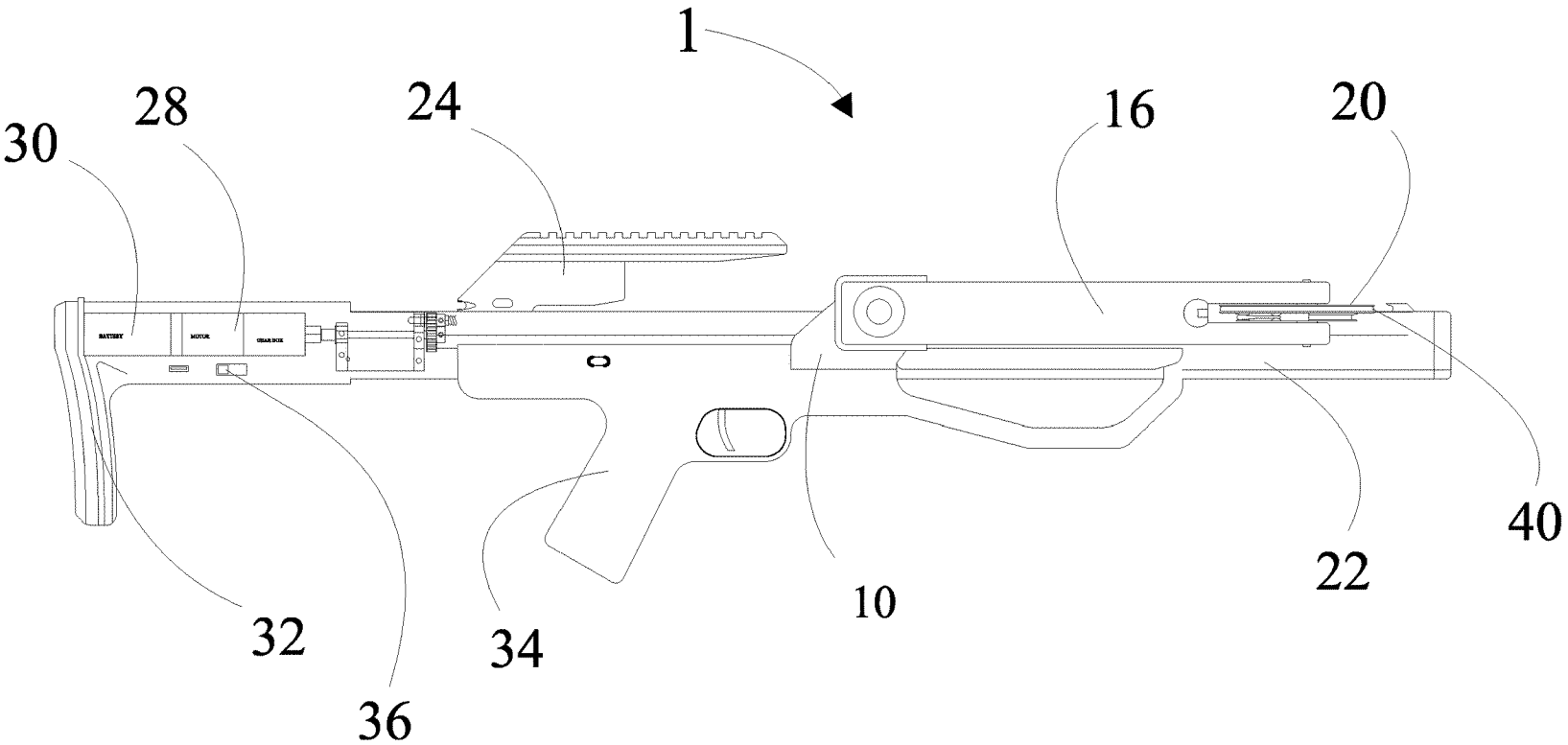
FIG. 1B is a side view of a crossbow with built in electric cocking with the motor gearbox assembly and power source in a rest position of the present invention.
Figure 1C:
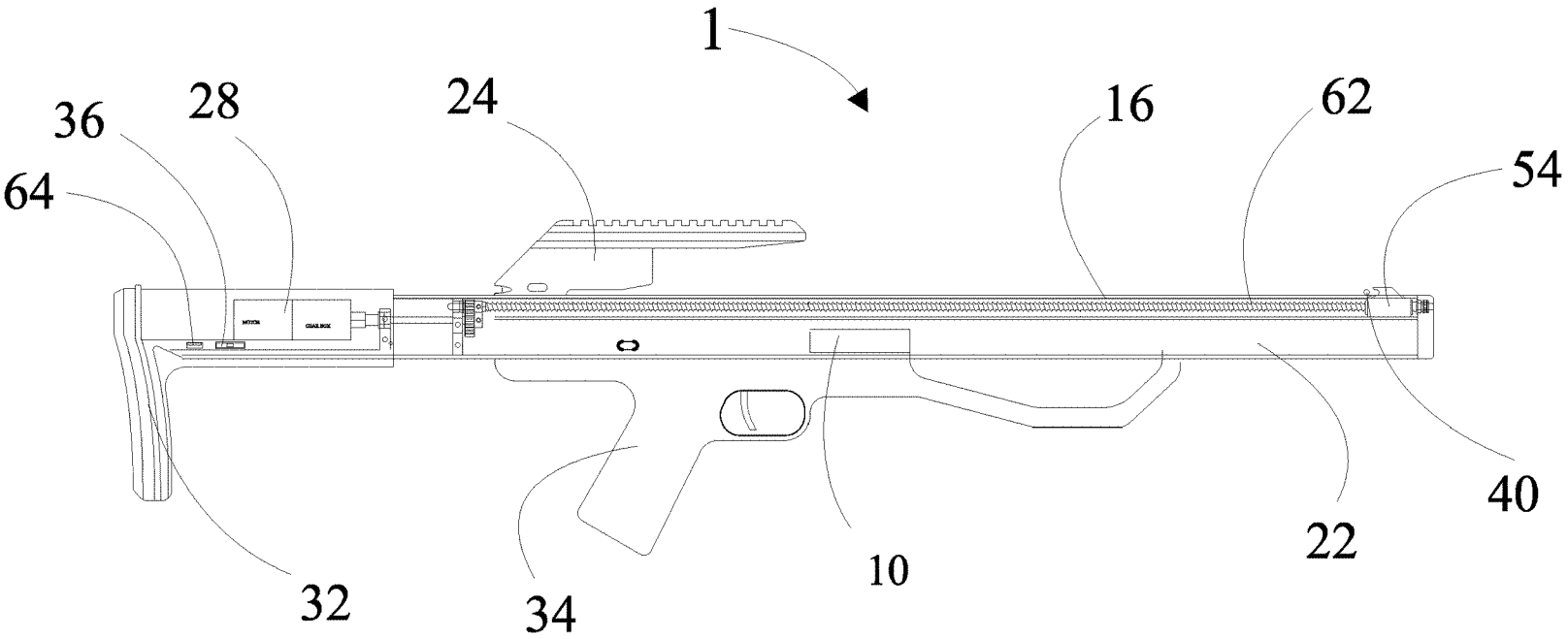
FIG. 1C is a partial cut-away side view of a crossbow with built in electric cocking with a motor gearbox assembly in a rest position; and a carriage shaft assembly and motor assembly are illustrated with a crossbow of the present invention.
Figure 2:
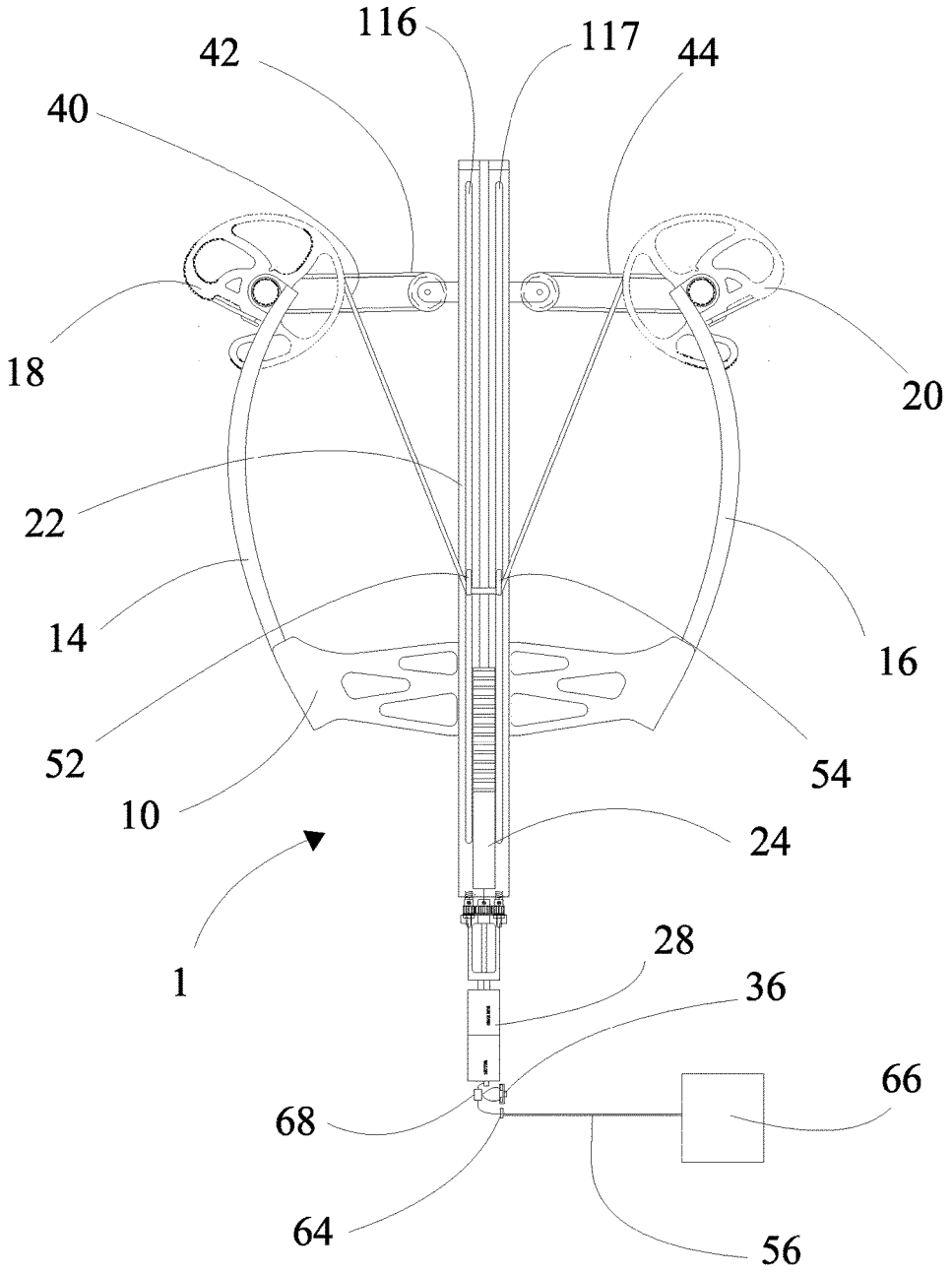
FIG. 2 is a top view of a crossbow with built in cocking device and motor gearbox assembly with external power source in a half-cocked position of the present invention.
Figure 2A:
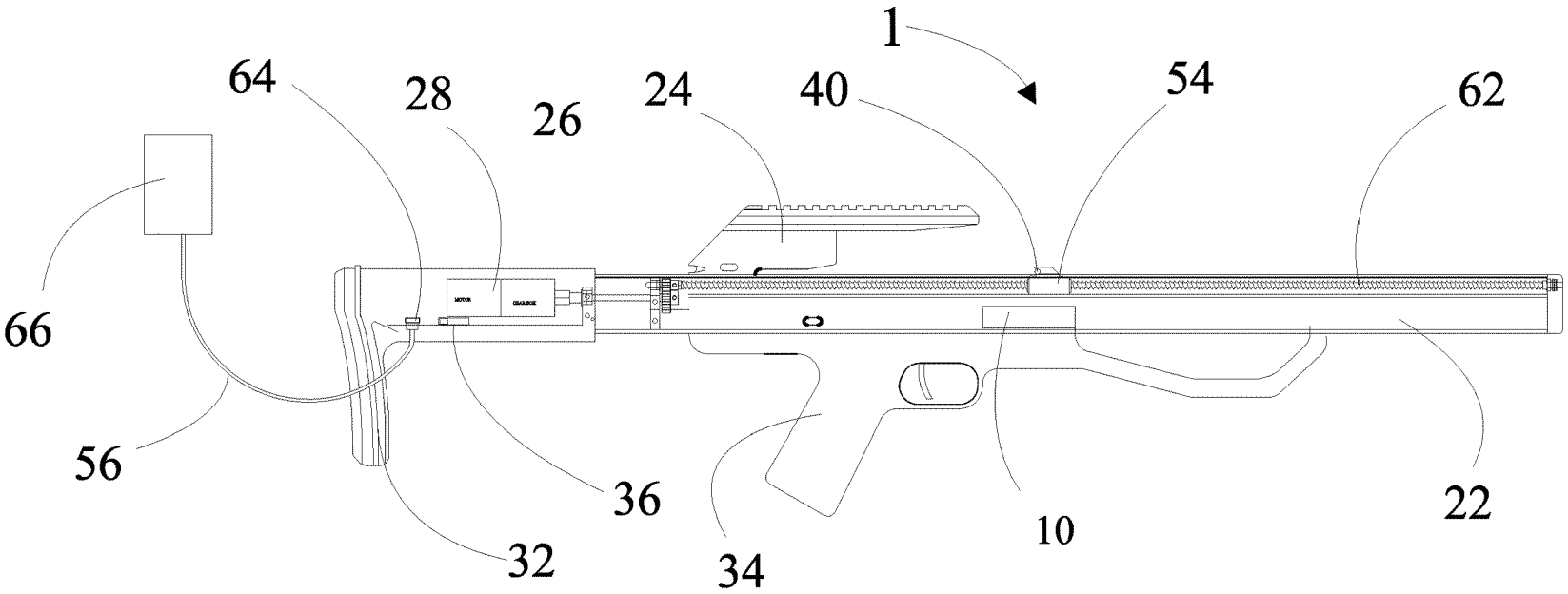
FIG. 2A is a partial cut-away side view of a crossbow with built in cocking device and motor gearbox assembly with external power source in a half-cocked position of the present invention.
Figure 2B:
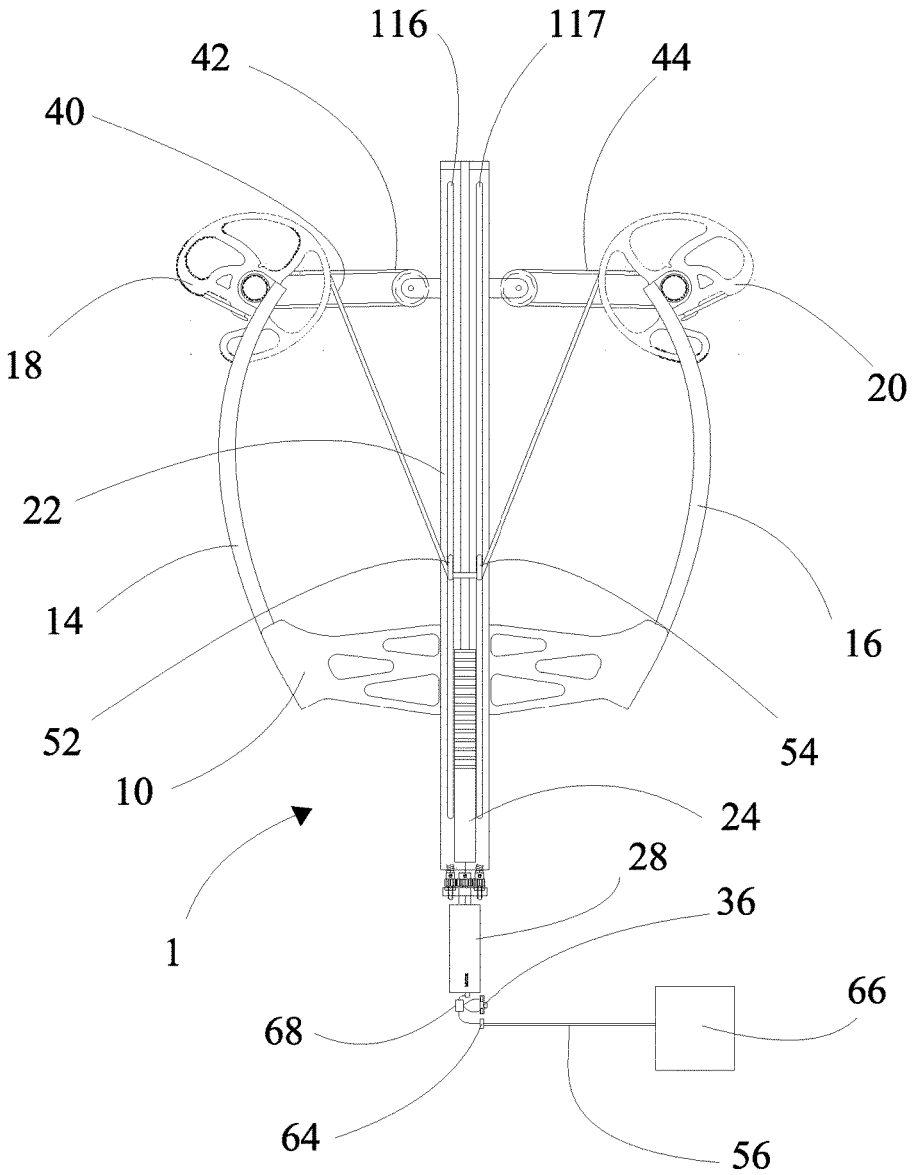
FIG. 2B is a top view of a crossbow with built in cocking device and direct drive motor gearbox assembly with external power source in a half-cocked position of the present invention.
Figure 3:
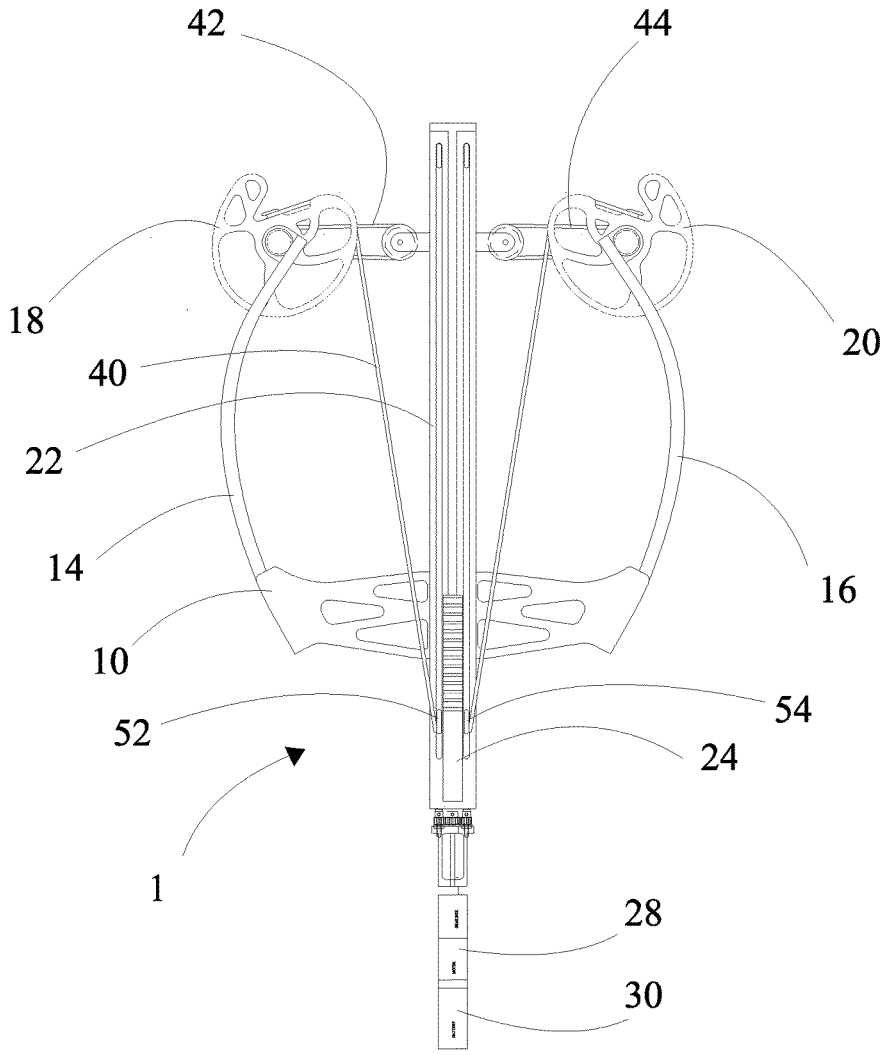
FIG. 3 is a top view of a crossbow with a built in cocking device and built in motor gearbox assembly and internal power source, in a just-cocked position of the present invention.
Figure 3A:
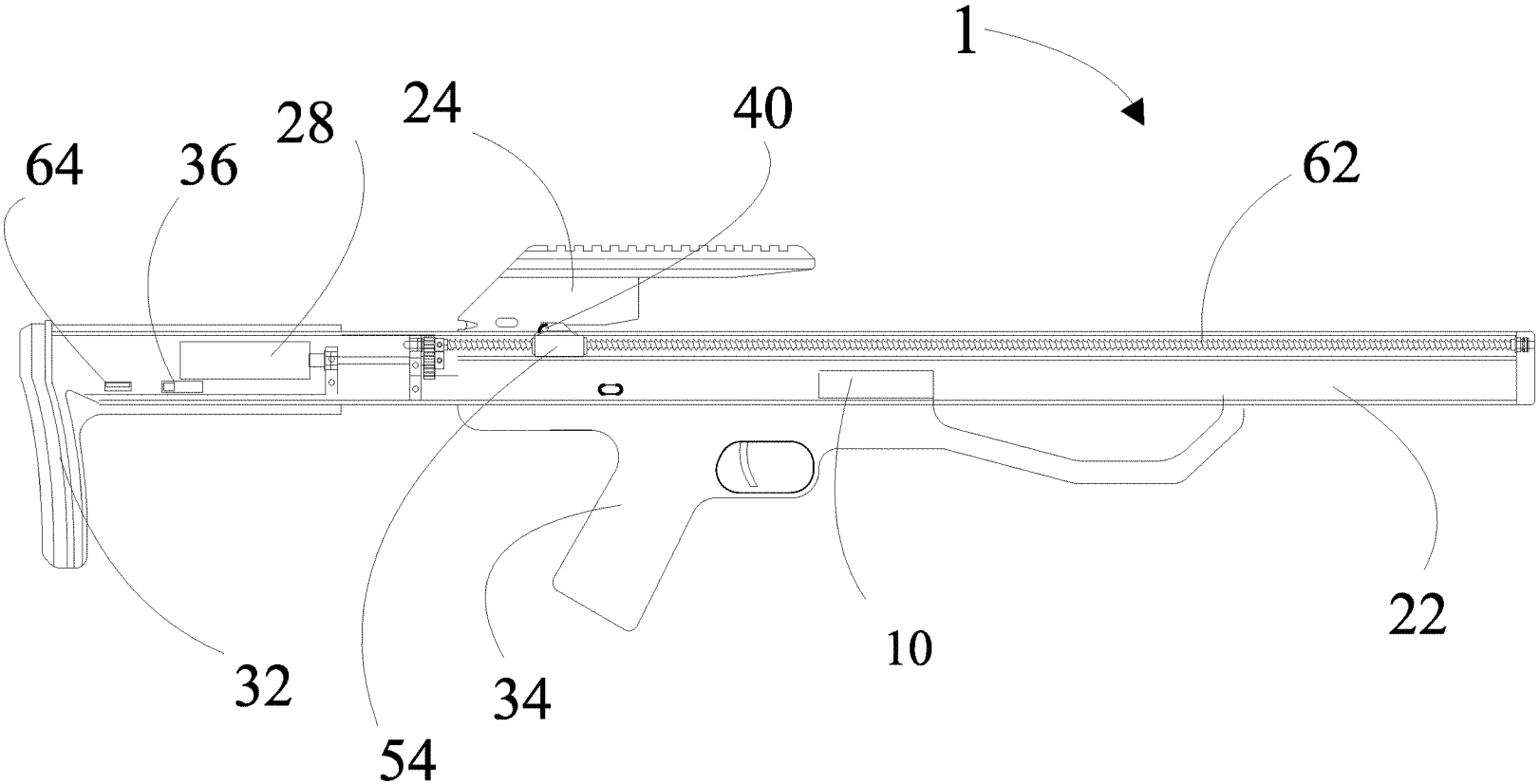
FIG. 3A is a partial cut-away side view of a crossbow with built in crank cocking device with motor gearbox assembly in a just-cocked position, of the present invention.
Figure 4:
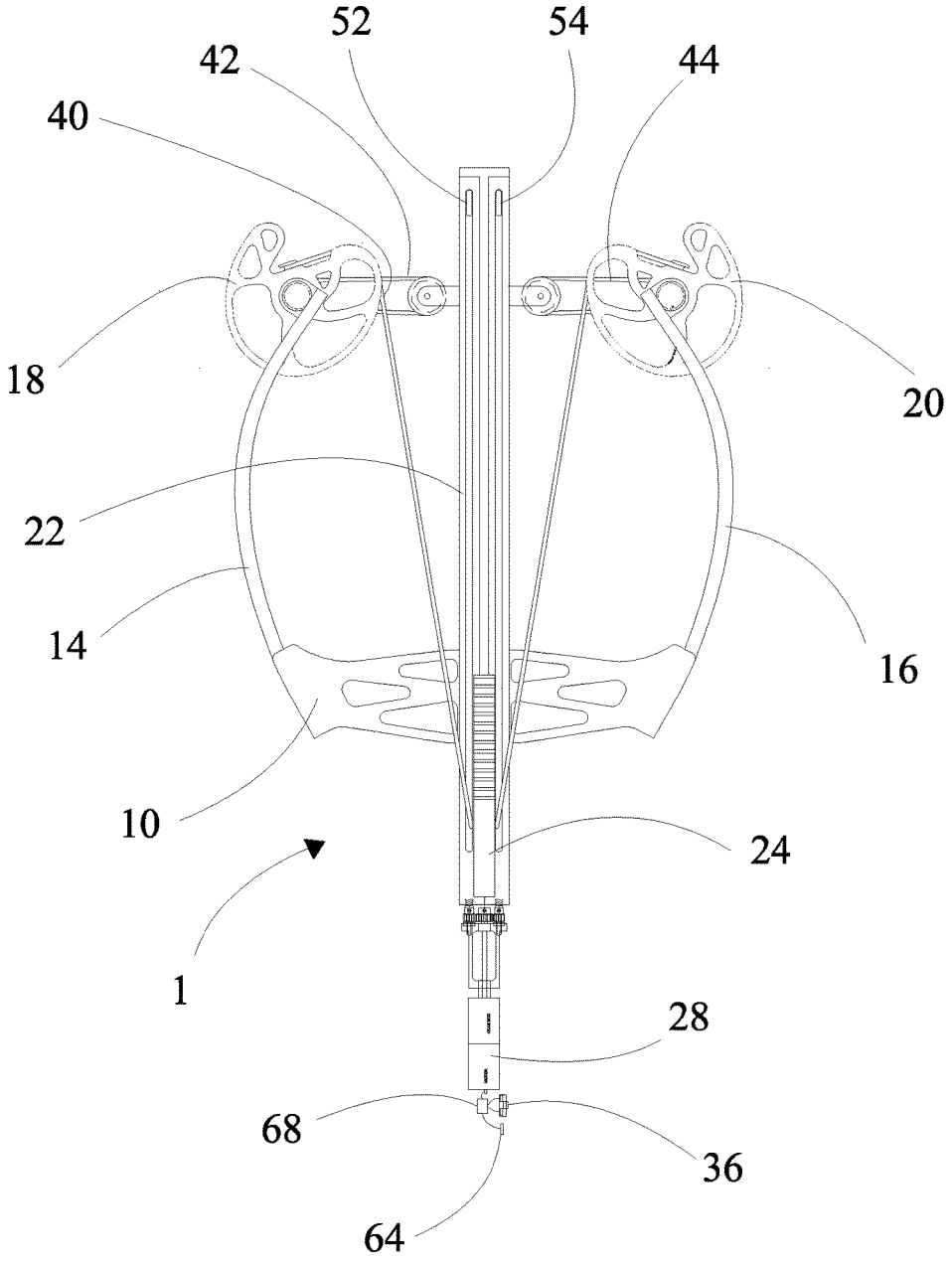
FIG. 4 is a top view of a crossbow with built in cocking device with motor gearbox assembly and external power source requirements, in the cocked position, and the carriages in a rest position of the present invention.
Figure 4A:
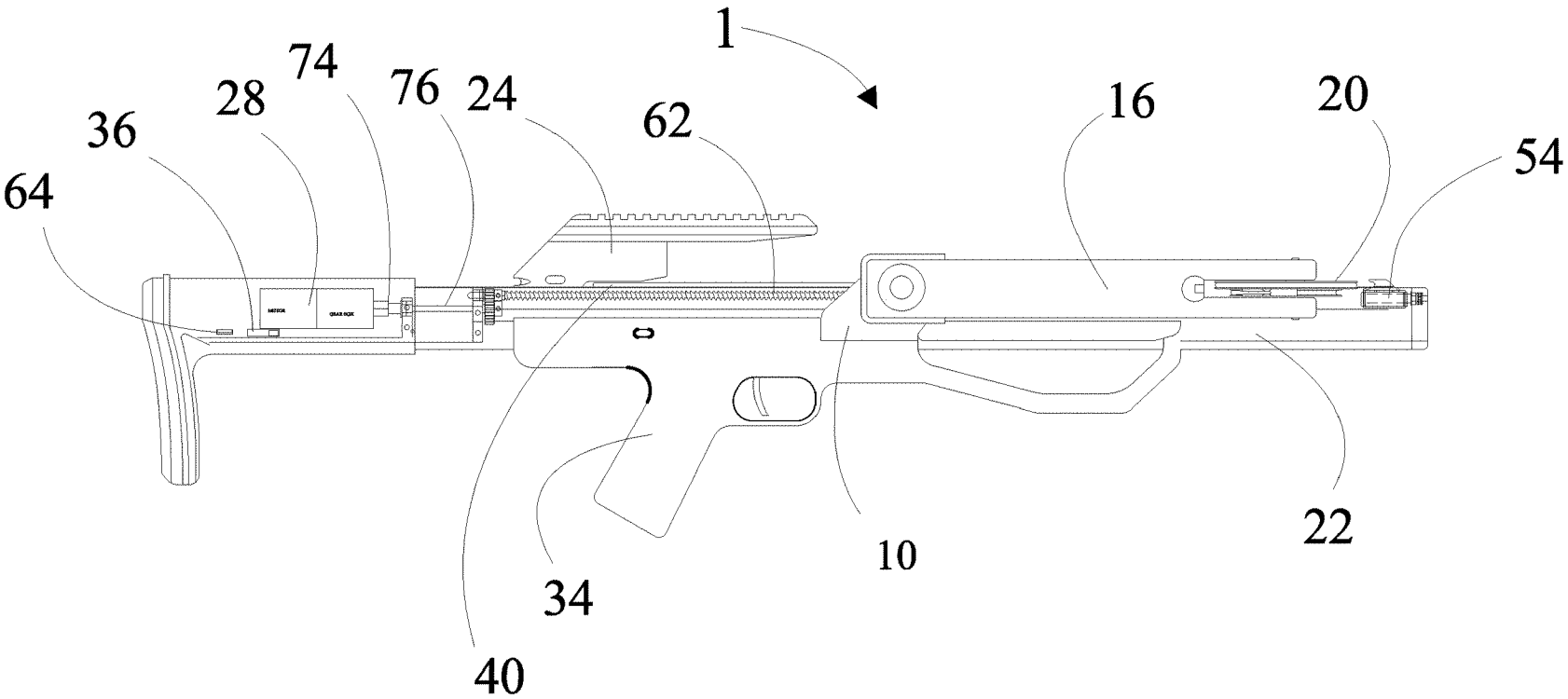
FIG. 4A is a partial cut-away side view of a crossbow with built in cocking device with motor gearbox assembly and external power source requirements in a cocked position, and carriages in a rest position, and the F.O.R. switch in a third position, of the present invention.
Figure 4B:
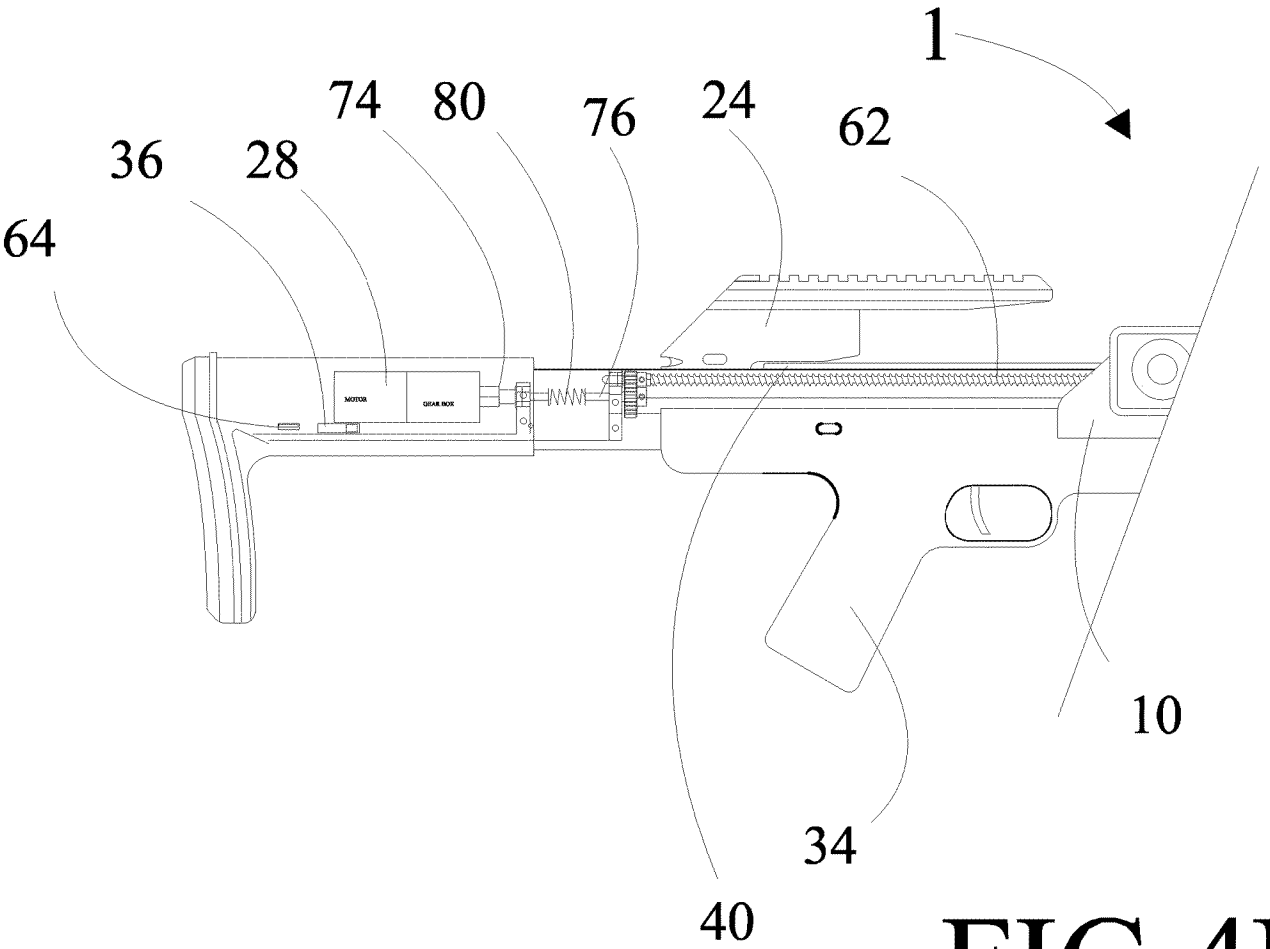
FIG. 4B is a partial cut-away side view of a crossbow with built in cocking device with motor gearbox assembly and external power source requirements with an alternate embodiment of a spring coupling a motor drive output shaft to a drive shaft of the present invention.

With reference now to the drawings, and particularly to FIGS. 1-4A, there are shown a preferred embodiment of a reverse crossbow 1 including an electric built-in cocking device. The crossbow 1 includes a riser 10, a barrel 22, a first bow limb 14 and a second bow limb 16, a first cam 18 and a second cam 20, a bow string 40, a stock 34, a butt stock 32, and a trigger housing 24. The first and second bow limbs 14 and 16 extend from opposing ends of the riser 10. The stock 34 extends from below the trigger housing 24 forward along the frame or barrel 22. The riser 10 is attached to the frame or barrel 22. The proximal ends of the first limb 14 and second limb 16 are joined with opposing ends of said riser 10. A first cam 18 is rotateably coupled with the distal end of said first limb 14, and said second cam 20 is rotate-ably coupled with the distal end of said second limb 16. A first end of said bow string 40 is retained on the first cam 40, and a second end of said bowstring 40 is retained on said second cam 20. The trigger housing 24 is contained within the frame or barrel 22. A crank handle 108 is operably coupled to a hand crank receiver 80, as illustrated in FIG. 6B.

Figure 5A:
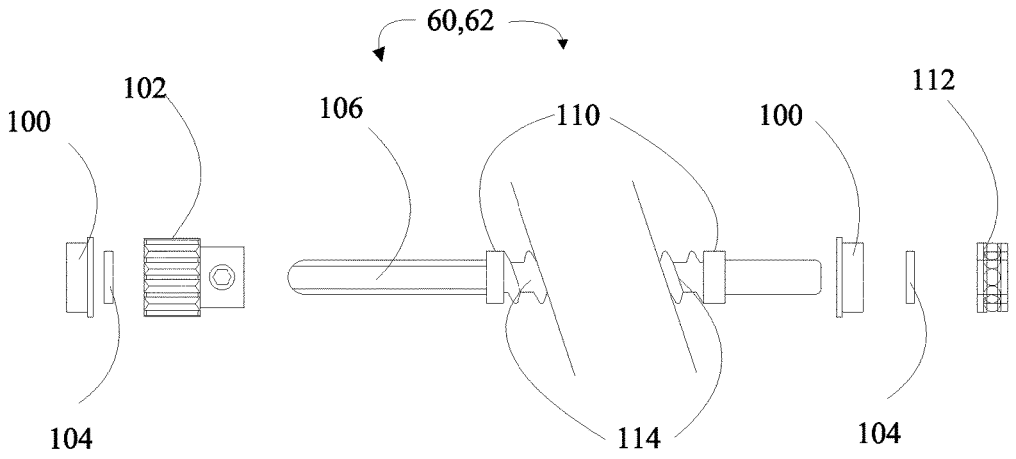
FIG. 5A is an exploded side view of a carriage shaft assembly of the present invention.
Figure 5B:
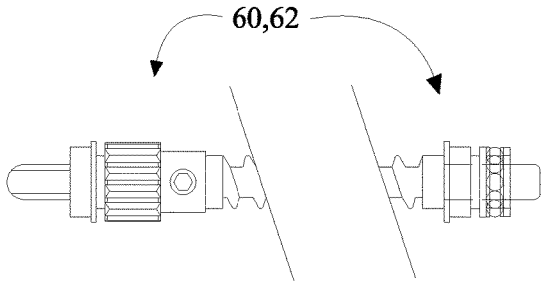
FIG. 5B is an assembled side view of a carriage shaft assembly, of the present invention.

With specific reference to FIGS. 5A and 5B, disclosed are a first carriage shaft assembly 60, and a second carriage shaft assembly 62. First and second carriage shaft assemblies 60, 62 have a distal end and a proximal end. First and second carriage shaft assemblies 60, 62 include a carriage shaft having threads 114; first and second carriage shaft transition spacers 110; carriage shaft bearings 100; shim spacers 104; a carriage shaft gear mounting surface 106; a carriage shaft drive gear 102 located at the proximal ends; and a thrust bearing 112 located at the distal ends.

Figure 6A:
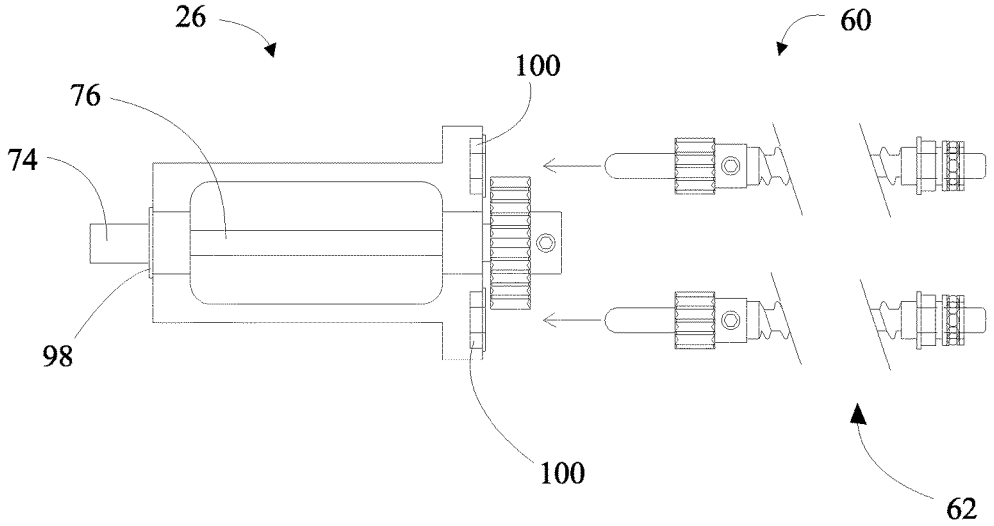
FIG. 6A is a top view of a gear and drive shaft assembly of the present invention.
Figure 6B:
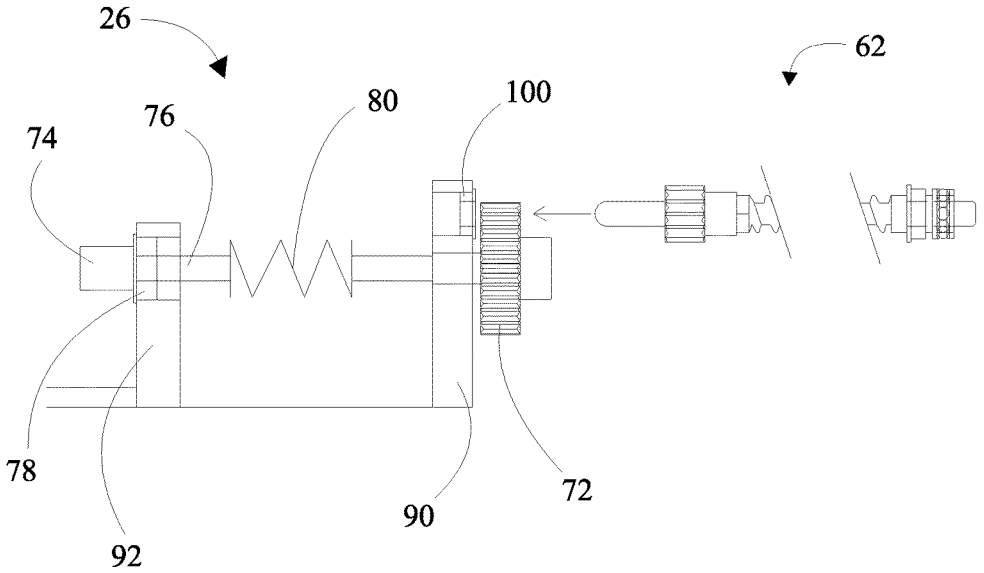
FIG. 6B is a side view of a gear and drive shaft assembly with a drive shaft coupling spring of the present invention.

With specific reference to FIGS. 6A and 6B, disclosed is a shaft assembly 26. The shaft assembly 26 includes a drive shaft coupling 74, a drive shaft 76, a drive shaft bearing 78, a drive shaft coupling spring 80, a shaft assembly front plate 90, a shaft assembly rear plate 92.

Carriage shaft bearings 100 are joined with the shaft assembly 26. The proximal ends of first carriage shaft assembly 60 and second carriage shaft assembly 62 are joined with the shaft bearings 100, while indexing the carriage shaft drive gears 102 with the drive shaft drive gear 72. The first string carriage 52 is joined with the first carriage shaft assembly 60, and a second string carriage 54 is joined with the second carriage shaft assembly 62, creating a combined working assembly 25. The combined working assembly 25 is joined with the barrel or frame 22.

A motor gearbox assembly 28 may be coupled to the drive shaft coupling 74. Said motor gearbox assembly 28 may have a built-in clutch assembly, whereby the rotational force applied by the said motor gearbox assembly reaches a predetermined amount of force, the rotation of the drive shaft 76 ceases. A switch 36 may be provided as to start, stop, and reverse the direction of rotation of the motor gearbox assembly 28, as well as any method known in the arts that may control operation of the motor gearbox assembly 28. Said motor gearbox assembly 28 may be removable from said crossbow 1.

A built-in, removable power source 30 may be integrated with the crossbow 1, and operably joined with motor gearbox assembly 28 and switch 36. The present invention provides a crossbow 1, and more specifically an electric built-in cocking mechanism for a crossbow 1.

Unique to the disclosed invention, the motor gearbox assembly 28 uses rotational force to directly or indirectly cause rotation of the carriage shaft assemblies 60 and 62. At least one internally threaded string carriage 52 is journaled, and an operable component of the carriage shaft assemblies 60. The first and second string carriages 52 and 54 are partially confined by a first and second string carriage guide track 51 and 53. The first and second string carriage guide tracks 51, and 53 prevent the first and second string carriages 52 and 54 from rotating as the shaft threads 114 rotate, which allows linear movement of the first string carriage 52 and rotational movement of carriage shaft threads 114 that act as a worm drive or acme thread conveyor. As the carriage shaft threads 114 rotate, the string carriages 52 and 54 move forward or backwards, depending on the direction of rotation of the drive shaft 76.

The string carriages 52 and 54 are set at the distal end of the crossbow 1 when at rest, or when the crossbow 1 is cocked and ready to shoot. When in use, the crank handle 108 is turned a first direction, causing the string carriages 52 and 54 to engage the string 40, and move the string 40 towards the string catch 27. Once the string catch 27 is latched to the string 40, the crank handle 108 is rotated in a second direction until the string carriages 52 and 54 are in the at-rest position at the distal end of the crossbow 1.

The motor gearbox assembly 28 may or may not have a clutch assembly, when the rotational force applied by the output shaft of the motor gearbox assembly 28 reaches a predetermined amount of force, the rotation of the drive shaft 76 ceases. A switch 36 may be provided as to start, stop, and reverse the direction of rotation of the output shaft of the motor gearbox assembly 28, as well as any method known in the art that may control operation of the motor gearbox assembly 28.

In use, a clutch pack in the motor gear assembly 28 would prevent the first and second string carriages 52 and 54 from traveling past the predetermined forward or rearward position during the cocking and un-cocking procedures. Any method known in the art, such as a micro-switch or electronic eye may also be used to control the operation of the motor gearbox assembly 28.

Further, unique to the present invention is the ability to de-cock the crossbow 1 without discharging it. The same procedure is used as cocking the crossbow 1. The drive shaft 76 is rotated a first direction, moving the string carriages 52 and 54 rearwards to engage the string 40. The string catch 27 is disengaged from the string, the drive shaft 76 is rotated in a second direction, until the string carriages 52 and 54 reach the at-rest position at the distal end of the crossbow 1.

Unique to the disclosed invention is the use of an external power source 66 used to power the motor gearbox assembly, said external power source 66 may provide power through a USB port 64.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention. Such changes may include, but are not limited to, different type of gears, position of gears, power sources, position of power sources, crossbow component construction of multiple elements, multi-element one-piece frame, cam configuration, string and cable configuration, and any other method known in the art of constructing a crossbow.

We claim:

1. An electric cocking device for a crossbow comprising:

a motor includes a gearbox;

a drive device includes a drive shaft, said drive shaft is rotatably retained in said drive device, a drive gear is retained on an end of said drive shaft, an opposing end of said drive shaft is attached to an output shaft of said gearbox;

first and second carriage drive shafts each include a threaded drive shaft and a carriage drive gear, said carriage drive gear is retained on one end of said threaded drive shaft, said carriage drive gear is driven by said drive gear; and first and second string carriages each include a string catch and a threaded tap, said threaded tap is sized to threadably receive said threaded drive shaft, wherein said drive gear is rotated by said motor to pull a bow string from a rest position to a cocked position.

2. The electric cocking device for a crossbow of claim 1, further comprising:

an external power supply for supplying electrical power to said motor.

3. The electric cocking device for a crossbow of claim 2 wherein:

said external power supply is connected to said motor through a USB port.

4. The electric cocking device for a crossbow of claim 1 wherein:

said motor with gearbox includes a forward, stop and reverse switch for operation.

5. The electric cocking device for a crossbow of claim 1, further comprising:

a travel controller for controlling a travel of said first and second string carriages, said travel controller is one of a micro-switch, an electronic eye and a proximity switch.

6. The electric cocking device for a crossbow of claim 1, further comprising:

a clutch pack having a clutch input and a clutch output, said clutch input is attached to said output shaft of said gearbox, said clutch output is attached to said drive shaft.

7. The electric cocking device for a crossbow of claim 1, further comprising:

said output shaft of said motor with gearbox is coupled to said drive shaft through a spring.

8. An electric cocking device for a crossbow comprising:

a motor;

a drive device includes a drive shaft, said drive shaft is rotatably retained in said drive device, a drive gear is retained on an end of said drive shaft, an opposing end of said drive shaft is attached to an output shaft of said motor;

first and second carriage drive shafts each include a threaded drive shaft and a carriage drive gear, said carriage drive gear is retained on one end of said threaded drive shaft, said carriage drive gear is driven by said drive gear; and first and second string carriages each include a string catch and a threaded tap, said threaded tap is sized to threadably receive said threaded drive shaft, wherein said drive gear is rotated by said motor to pull a bow string from a rest position to a cocked position.

9. The electric cocking device for a crossbow of claim 8, further comprising:

an external power supply for supplying electrical power to said motor.

10. The electric cocking device for a crossbow of claim 9 wherein:

said external power supply is connected to said motor through a USB port.

11. The electric cocking device for a crossbow of claim 8 wherein:

said motor includes a forward, stop and reverse switch for operation.

12. The electric cocking device for a crossbow of claim 8, further comprising:

a travel controller for controlling a travel of said first and second string carriages, said travel controller is one of a micro-switch, an electronic eye and a proximity switch.

13. The electric cocking device for a crossbow of claim 8, further comprising:

a clutch pack having a clutch input and a clutch output, said clutch input is attached to said output shaft of said motor, said clutch output is attached to said drive shaft.

14. The electric cocking device for a crossbow of claim 8, further comprising:

said output shaft of said motor is coupled to said drive shaft through a spring.

* * * * *